US012565705B2

(12) United States Patent
Furusawa

(10) Patent No.: US 12,565,705 B2
(45) Date of Patent: Mar. 3, 2026

(54) ELECTROLESS PLATING APPARATUS

(71) Applicant: ASKA CORPORATION, Fukuoka (JP)

(72) Inventor: Takayuki Furusawa, Fukuoka (JP)

(73) Assignee: ASKA CORPORATION, Fukuoka (JP)

( * ) Notice: Subject to any disclaimer, the term of this patent is extended or adjusted under 35 U.S.C. 154(b) by 442 days.

(21) Appl. No.: 18/258,995

(22) PCT Filed: Dec. 20, 2021

(86) PCT No.: PCT/JP2021/046925

§ 371 (c)(1),
(2) Date: Jun. 22, 2023

(87) PCT Pub. No.: WO2022/138528

PCT Pub. Date: Jun. 30, 2022

(65) Prior Publication Data

US 2024/0044007 A1 Feb. 8, 2024

(30) Foreign Application Priority Data

Dec. 25, 2020 (JP) ..... 2020-216621

(51) Int. Cl.
*C23C 18/16* (2006.01)
*C23C 18/31* (2006.01)

(52) U.S. Cl.
CPC ..... *C23C 18/31* (2013.01); *C23C 18/1619* (2013.01); *C23C 18/1628* (2013.01); *C23C 18/1632* (2013.01); *C23C 18/1642* (2013.01)

(58) Field of Classification Search
None
See application file for complete search history.

(56) References Cited

U.S. PATENT DOCUMENTS 4,980,300 A * 12/1990 Miyashita ..... H01L 21/67023 134/1
2002/0027080 A1* 3/2002 Yoshioka ..... C25D 17/001 204/252

(Continued)

FOREIGN PATENT DOCUMENTS

JP S52-133038 A 11/1977
JP H05-106055 A 4/1993

(Continued)

OTHER PUBLICATIONS

International Search Report for the corresponding application No. PCT/JP2021/046925, mailed Mar. 22, 2022, with English translation, 4 pages.

(Continued)

*Primary Examiner* — Binu Thomas
(74) *Attorney, Agent, or Firm* — LUCAS & MERCANTI, LLP

(57) ABSTRACT

An electroless plating apparatus includes: a plating bath; a reserve tank; a retaining means for retaining a plurality of semiconductor wafers upright at regular intervals; a plating liquid circulating path; a circulating pump; a flowmeter and a plating liquid supply pipe having a plurality of spouts formed in an upper part thereof at regular intervals. The regular intervals at which the plurality of semiconductor wafers are retained upright by the retaining means are the same as the regular intervals at which the plurality of spouts are formed in the upper part of the plating liquid supply pipe. The plurality of spouts formed on the upper part of the plating liquid supply pipe may be positioned within the regular intervals between the plurality of semiconductor wafers being retained by the retaining means.

3 Claims, 10 Drawing Sheets

(56) References Cited

U.S. PATENT DOCUMENTS

| | | | | |
|---|---|---|---|---|
| 2007/0267040 | A1* | 11/2007 | Watanabe | H01L 21/67057 134/1 |
| 2013/0122704 | A1 | 5/2013 | Kanda et al. | |
| 2019/0360105 | A1* | 11/2019 | Nakamura | C23C 18/1651 |
| 2021/0082728 | A1* | 3/2021 | Kinoshita | H01L 21/67057 |
| 2023/0274956 | A1* | 8/2023 | Kimura | H01L 21/67051 134/26 |

FOREIGN PATENT DOCUMENTS

| | | | | |
|---|---|---|---|---|
| JP | 2004-162093 | A | 6/2004 | |
| JP | 2019-206729 | A | 12/2019 | |
| WO | WO-2021048983 | A1 * | 3/2021 | H01L 21/67757 |

OTHER PUBLICATIONS

Office Action for the corresponding Japanese Patent Application No. 2020-216621, issued on Mar. 15, 2022, with machine English translation, 8 pages.

Office Action for the corresponding Taiwanese Patent Application No. 110148749, issued on Jul. 5, 2023, with machine English translation.

* cited by examiner

[Fig. 1]
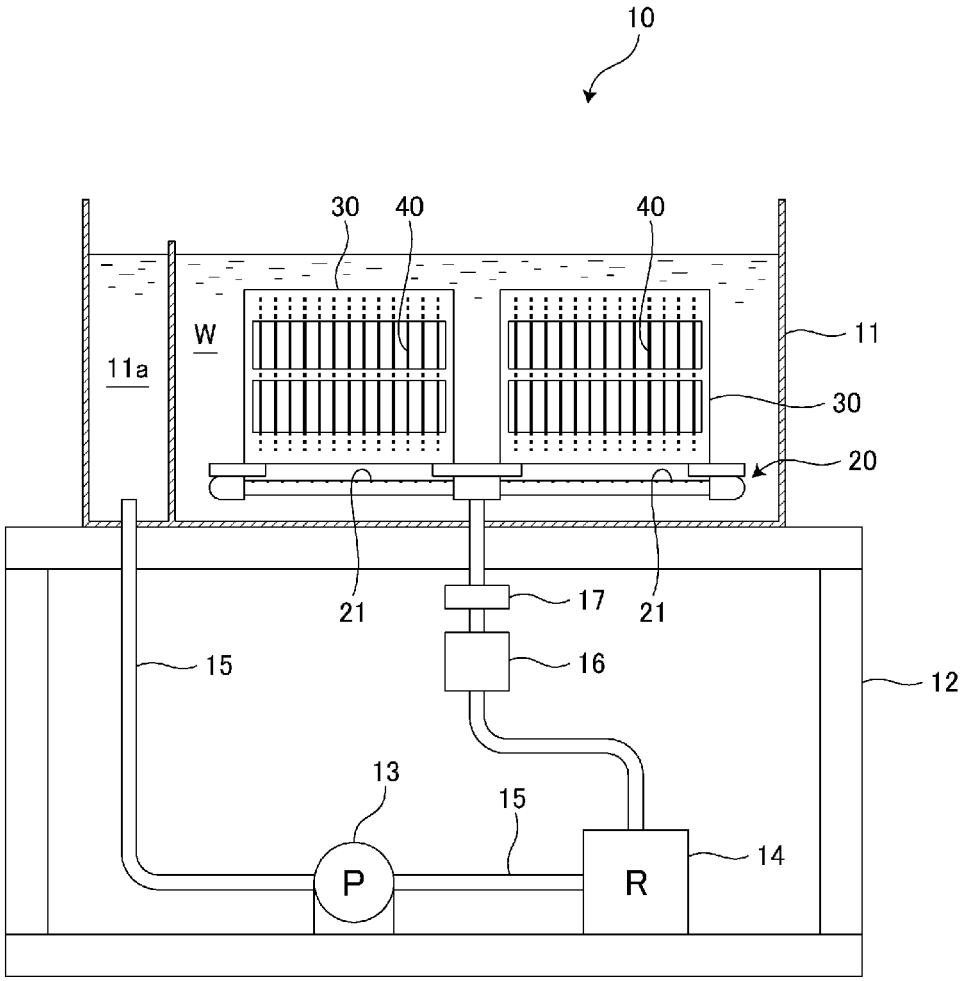

[Fig. 2]
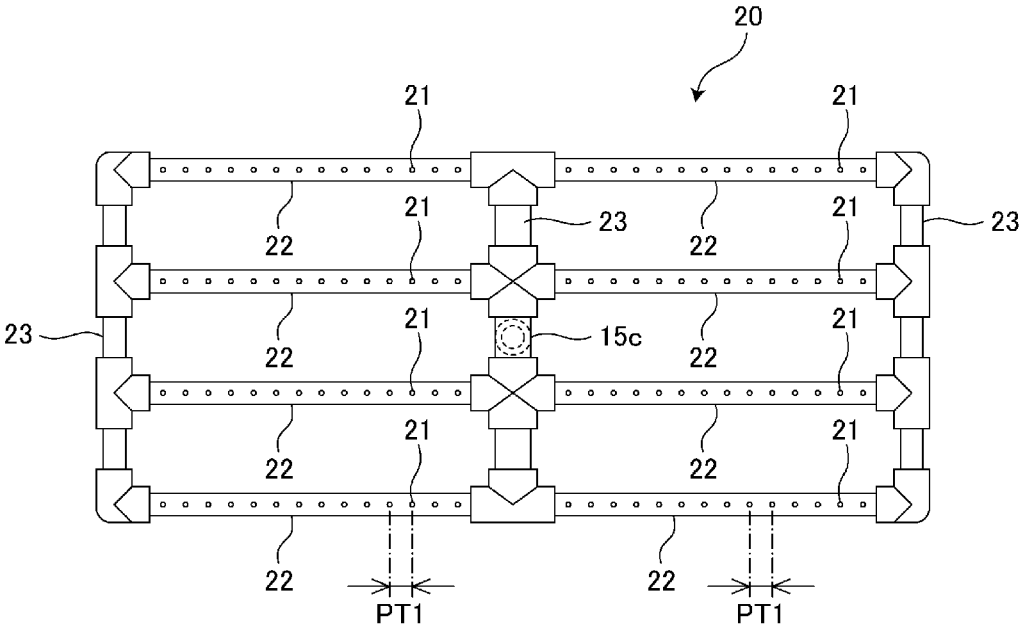

[Fig. 3]
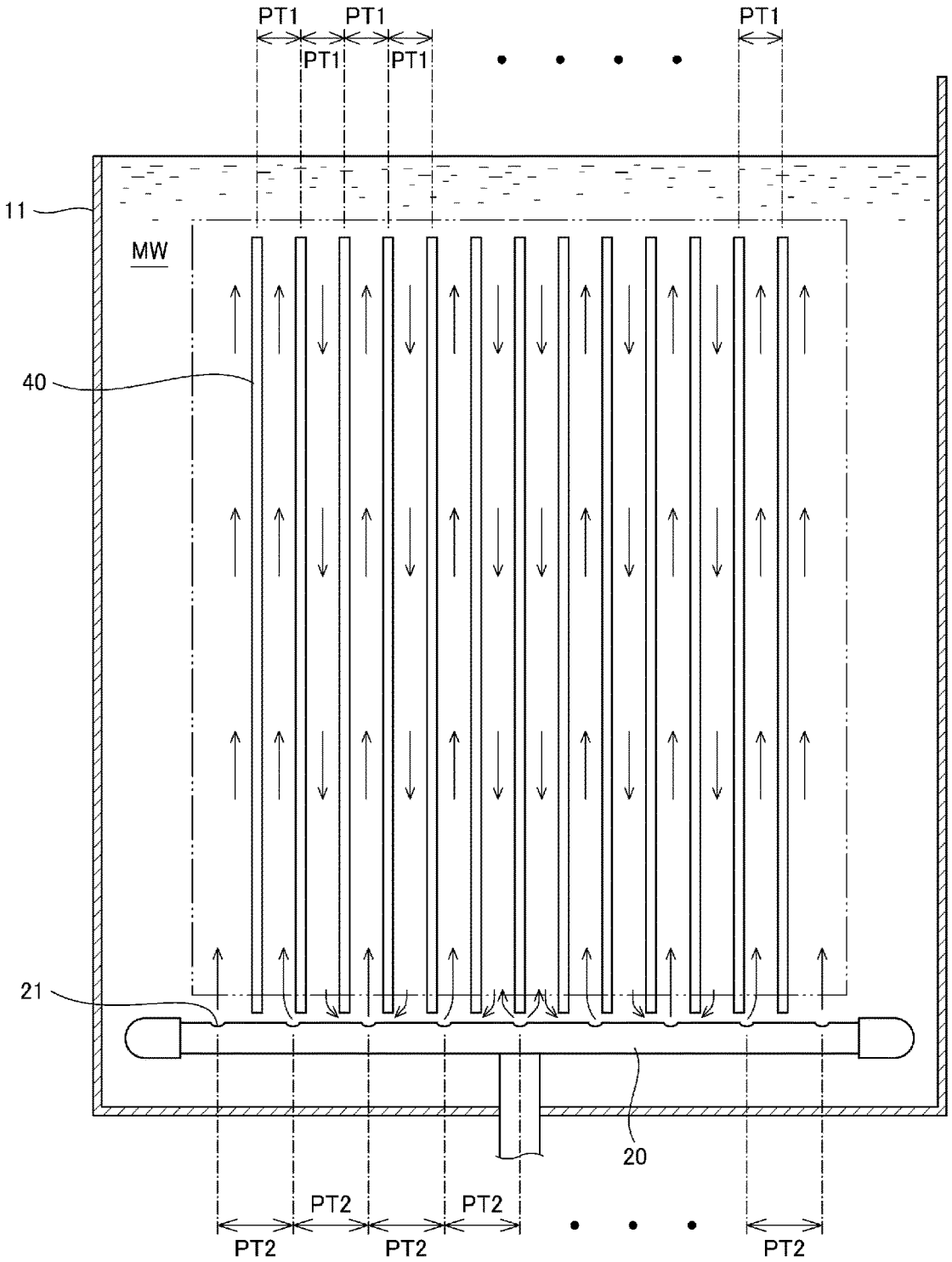

[Fig. 4]
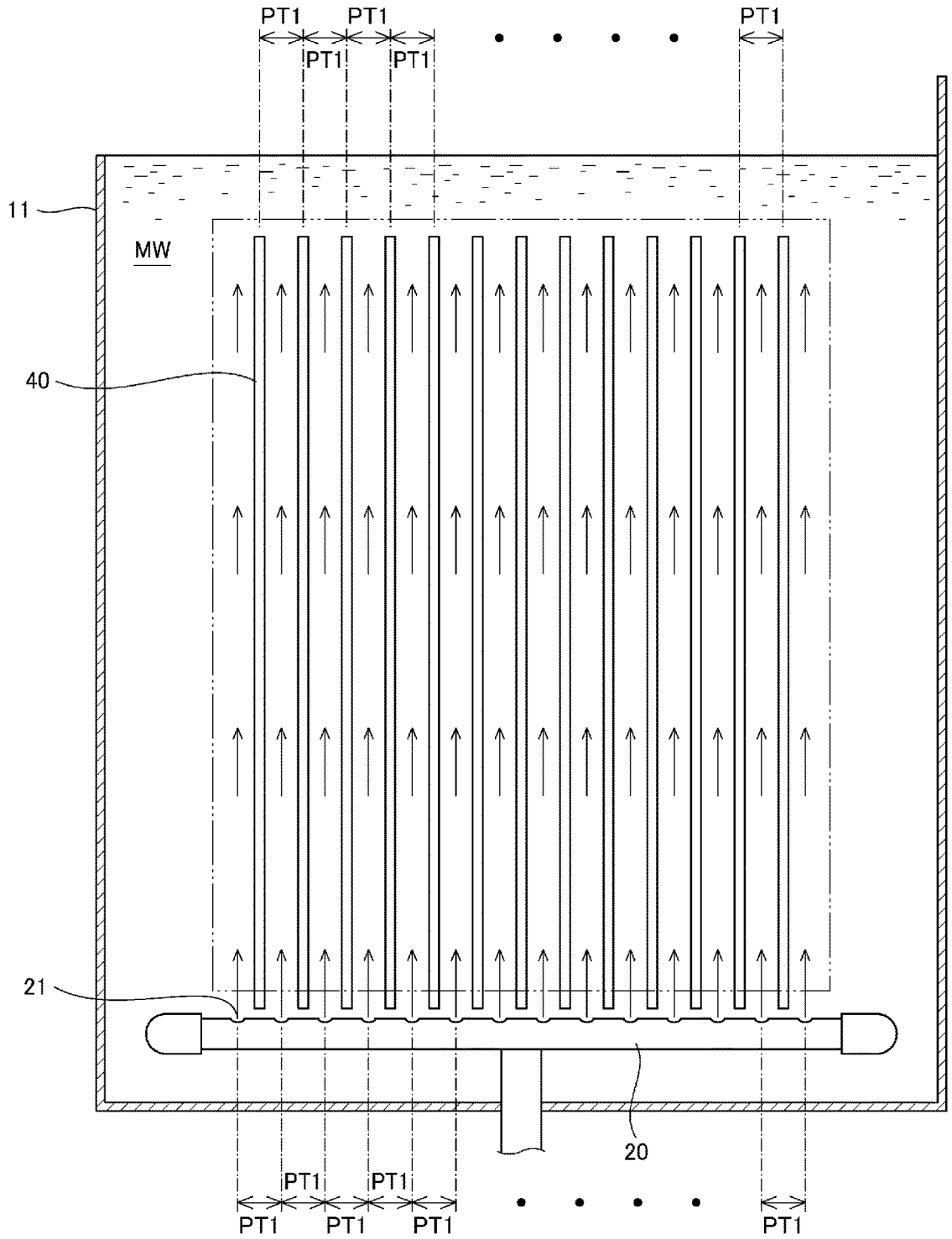

[Fig.5]
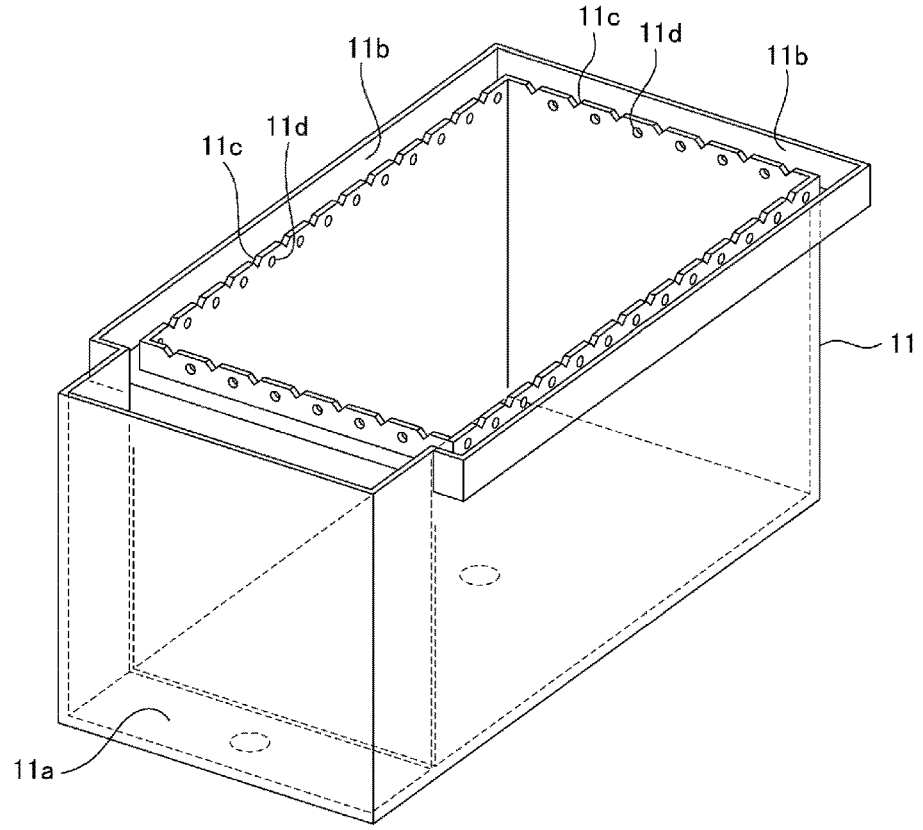
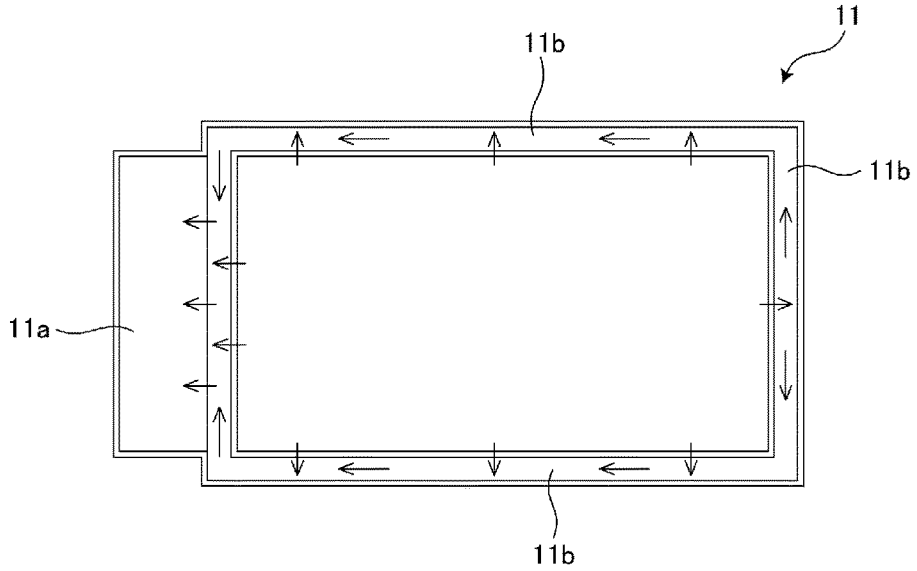

[Fig. 6]
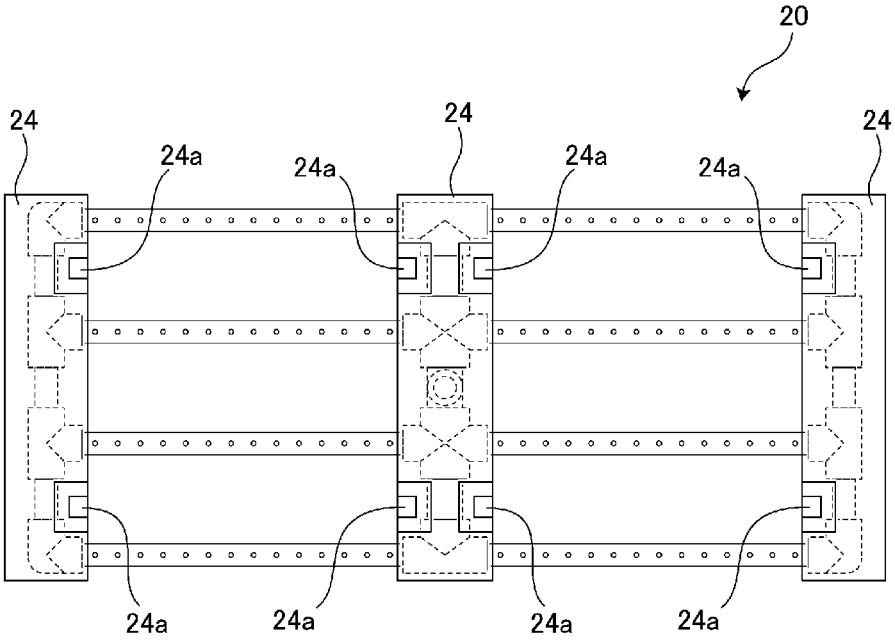

[Fig. 7]
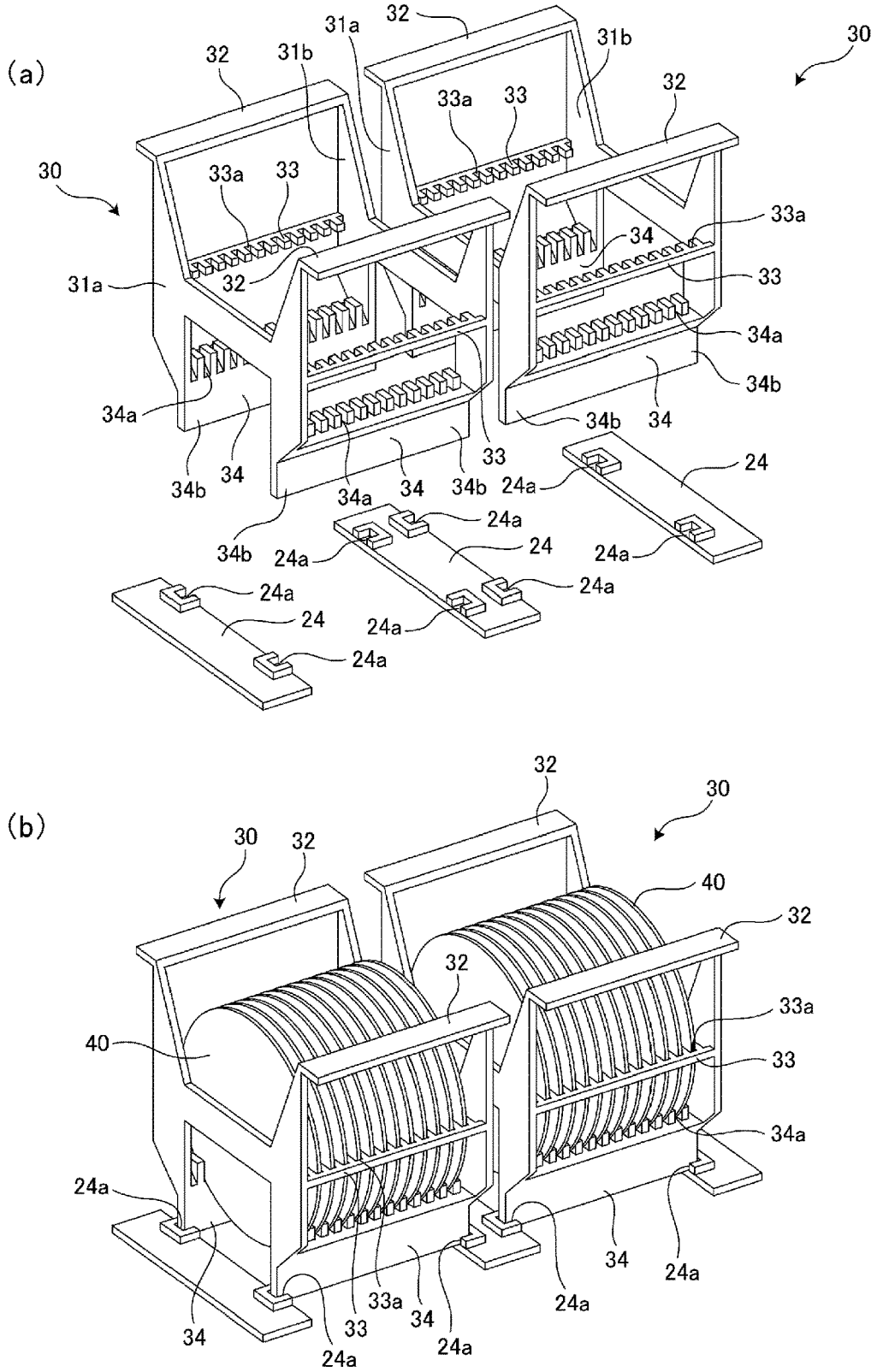

[Fig. 8]
(a)
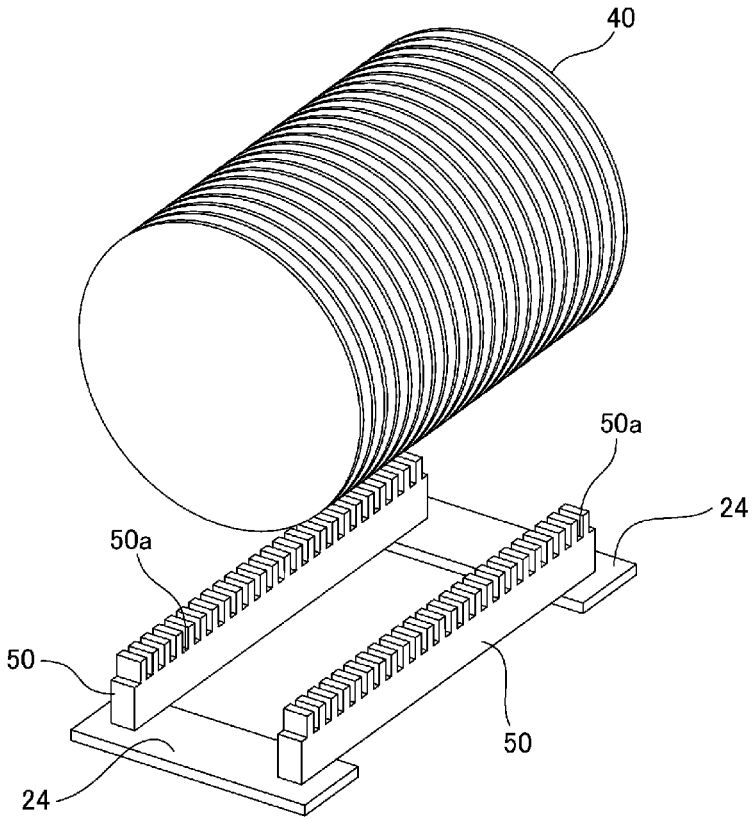
(b)
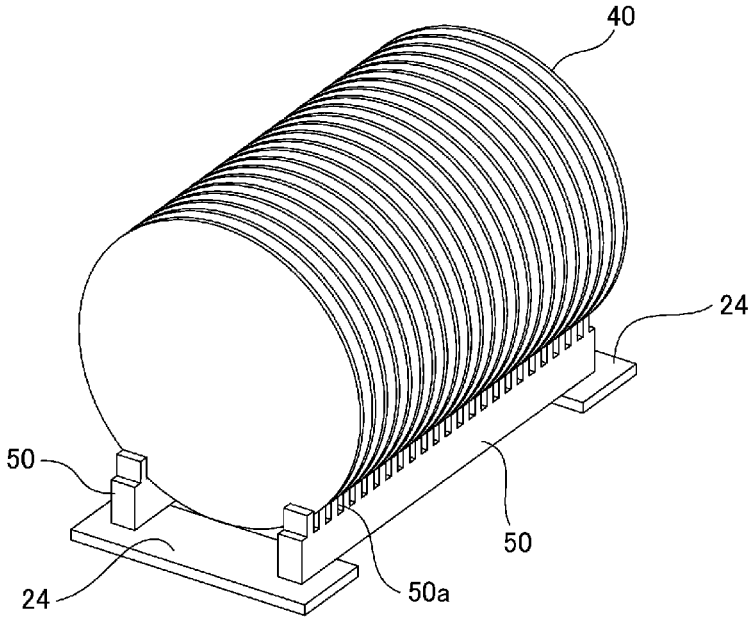

[Fig. 9]
(a)
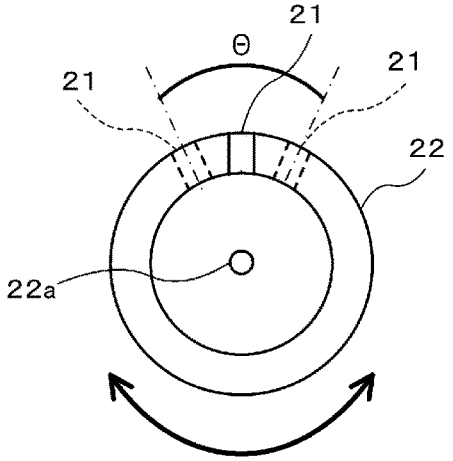
(b)
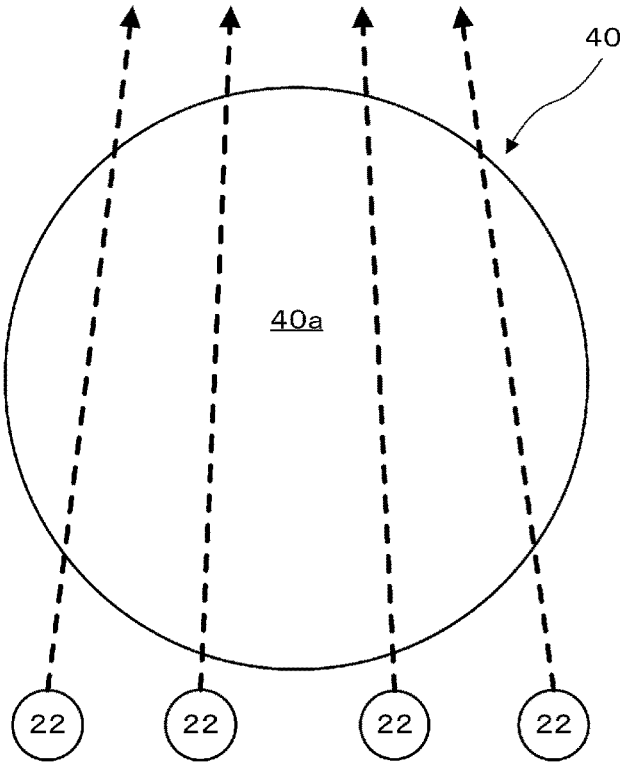

[Fig. 10]
(a)
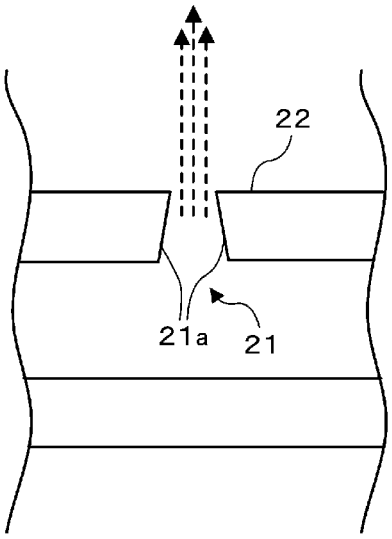
(b)
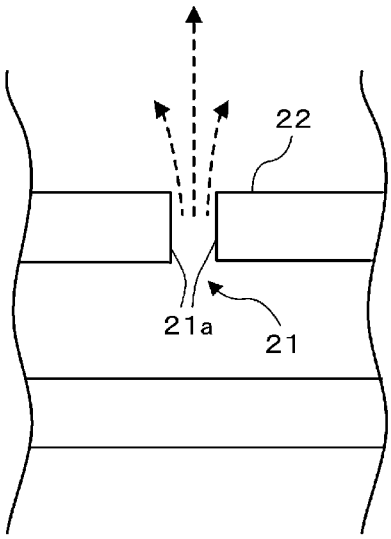

ELECTROLESS PLATING APPARATUS

CROSS REFERENCE TO RELATED APPLICATION

This Application is a 371 of PCT/JP2021/046925 filed on Dec. 20, 2021, which, in turn, claims priority of Japanese Patent Application No. 2020-216621 filed on Dec. 25, 2020, and the above applications are incorporated herein by reference.

TECHNICAL FIELD

The present invention relates to an electroless plating apparatus through which metallic plating with uniformity and high quality can be done on a plating surface of a semiconductor wafer.

BACKGROUND ART

Recently, according to high performance of electronic components, it is further desired uniform characteristic and high quality of plating film by semiconductor wafer metal (for example, nickel and the like).

In formation of the plating film of electroless plating, the plating film is formed by chemical reaction between plating liquid in which plated metallic ion is dissolved and metal (for example, aluminum) on surface of the semiconductor wafer. Therefore, it is well-known that flow characteristic of the plating liquid flowing on the plating surface of semiconductor wafer greatly influences formation of plating film.

Thus, it is conducted that a plating tank in which the plating liquid is filled is upsized and the semiconductor wafer is immersed in this platting tank, thereby influence of flow characteristic of the plating liquid is made smaller and flow uniformity of the plating liquid flowing on the plating surface of the semiconductor wafer is attempted. However, when the plating tank is upsized, it is necessary large amount of the plating liquid, further the apparatus becomes gigantic and equipment is costed.

According to repetition of plating process, reaction by-product and by-product such as metallic ion and the like eluted from object to be plated are accumulated in the plating liquid, thus quality of the plated film is degraded. Therefore, the plating liquid is regularly exchanged and the plating liquid after used is discarded. Since large amount of impurities (phosphate and the like) are mixed in the discarded plating liquid, a value of COD (Chemical Oxygen Demand which is oxygen amount consumed when organic matter in water is oxidized by oxidant and is a representative index used in measurement of organic pollution in lake or sea area) becomes large and there is a fear that such impurities become environment load factor.

Therefore, in order to form the plating film with excellent uniform film thickness and film quality onto the surface to be plated of the semiconductor wafer, while keeping equipment costs down and considering environment load, it is disclosed a producing apparatus for semiconductor device, the producing apparatus comprising a reactor for forming the plating film on the semiconductor wafer by immersing the semiconductor in reaction solution, a supply pipe extended within the reactor and having a plurality of spouts to erupt the reaction solution formed along an extended direction of the supply pipe and a reserve tank provided adjacent to the reactor at one side of the supply pipe and accumulating the reaction solution overflowed from the reactor, wherein an aperture ratio in a part far way from the reserve tank among the plurality of spouts is at least partially made large than the aperture ration of the part closer to the reserve tank (see patent literature 1).

CITATION LIST

Patent Literature

Patent Literature 1

Unexamined Patent Application Laid Open Number 2019-2067729

SUMMARY OF INVENTION

Technical Problem

However, in the producing apparatus for semiconductor device disclosed in Patent Literature 1, it is not too much that the aperture ratio in a part far away from the reserve tank among the plurality of spouts is at least partially made large than the aperture ratio of the part closer to the reserve tank. With this, flow of the reaction solution (plating liquid) vertically passing from a lower part toward an upper part between the semiconductor wafers retained in a career in which a plurality of semiconductor wafers are vertically retained, cannot be made uniform.

Due to this, it cannot be perfectly prevented that bubbles of hydrogen and the like occurring in the plating liquid during electroless plating process adheres to the plating surface of the semiconductor wafer and stays on the plating surface. Thereby, unevenness in the film thickness of the surface to be plated in the semiconductor wafer is produced and it is difficult to form the film thickness with uniformity and high quality.

Considering the above problem, the present invention provides an electroless plating apparatus through which the metallic plating (nickel) having a film thickness with uniformity and high quality can be formed on the surface to be plated of the semiconductor wafer.

Solution to Problem

The present invention provides an electroless plating apparatus comprising a plating bath in which plating liquid is filled, a reserve tank for accumulating the plating liquid overflowed from the plating bath, a retaining means for retaining a plurality of semiconductor wafers upright at regular intervals so that surfaces to be plated of the plurality of semiconductor wafers are not contacted, a supply path for supplying the plating liquid of the reserve tank to the plating bath, a circulation pump for supplying the plating liquid of the reserve tank to the plating bath through the supply path, a flowmeter for measuring velocity of the plating liquid in the supply path and a supply pipe of the plating liquid in which a plurality of spouts to erupt the plating liquid from the reserve tank to the plating bath are formed at regular intervals in an upper part thereof, wherein a constant interval with which the plurality of semiconductor wafers are retained in the retaining means upright and a constant interval with which the plurality of spouts are formed in the upper part of the supply pipe of the plating liquid is made equal each other and the plurality of spouts formed on the upper part of the supply pipe of the plating liquid are arranged so that each of the spouts is positioned between each constant interval of the plurality of semiconductor wafers retained in the retaining means when the retained is set up at the upper part of the supply pipe of the plating liquid which is set up at a bottom of the plating bath.

Further, the retaining means is a wafer career in which strength to retain the plurality of semiconductor wafers is secured and an area contacting with the plurality of semiconductor wafers is formed minimum.

In the supply pipe of the plating liquid, an angle of the spout to erupt the plating liquid upward is made adjustable with a predetermined range by making a center axis of the supply pipe of the plating liquid as a pivot shaft.

The spout is formed in conical shape expanded downward.

Advantageous Effects of Invention

According to the present invention, the plating surfaces of a plurality of the semiconductor wafers are retained upright under face-to-face condition with holding a regular interval between two adjacent plating surfaces in the retaining means so that the plurality of plating surfaces are not contacted with each other and the plating liquid is erupted upward toward the regular intervals of the plurality of semiconductor wafers retained in the retaining mans from the plurality of spouts formed at the upper part of the supply pipe of the plating liquid with regular intervals, the supply pipe of the plating liquid being arranged the lower part of the retaining means immersed in the plating bath. Thus, flow of the plating liquid communicating from bottom to top toward the regular intervals of the plurality of semiconductor wafers can be surely formed. That is, flow of the plating liquid communicating from bottom to top between the plating surfaces of the semiconductor wafers can be equalized as much as possible and it can be kept low as much as possible that bubbles of hydrogen and the like occurring in the plating liquid during electroless plating process adhere and stay to the plating surface of the semiconductor wafer. Thereby, unevenness of film thickness on the surface to be plated of the semiconductor wafer can be prevented and uniformity of film quality can be realized. That is, by using the plating bath with requisite minimum size in which plating liquid is filled, metallic plating film with predetermined thickness, uniformity and high quality can be formed on the surface to be plated of the semiconductor wafer, while considering cost reduction and environment load.

BRIEF DESCRIPTION OF DRAWINGS

FIG. 1 is a front view to explain a composition of the electroless plating apparatus according to the present embodiment.

FIG. 2 is a plan view to explain the supply pipe of the plating liquid of the electroless plating apparatus according to the present embodiment.

FIG. 3 is a schematic view to explain flow of the plating liquid in a conventional electroless plating apparatus.

FIG. 4 is a schematic view to explain flow of the plating liquid in the electroless plating apparatus according to the present embodiment.

FIG. 5 is a perspective view to explain s composition of the plating bath of the electroless plating apparatus according to the present embodiment.

FIG. 6 is a perspective view to explain a mounting plate of the retaining means arranged on the upper part of the supply pipe of the plating liquid in the electroless plating apparatus according to the present embodiment.

FIG. 7 is a perspective view to explain a composition of the wafer career which is the retaining means of the semiconductor wafer in the electroless plating apparatus according to the present embodiment.

FIG. 8 is a perspective view to explain a composition of modification of the retaining means of the semiconductor wafer in the electroless plating apparatus according to the present embodiment.

FIG. 9 is a sectional view to explain an angle adjuster of the spouts of the supply pipe of the semiconductor wafer in the electroless plating apparatus according to the present embodiment.

FIG. 10 is a sectional view to explain a shape of the spout of the supply pipe of the plating liquid in the electroless plating apparatus according to the present embodiment.

DESCRIPTION OF EMBODIMENTS

The present invention relates to an electroless plating apparatus comprising a plating bath in which plating liquid is filled, a reserve tank for accumulating the plating liquid overflowed from the plating bath, a retaining means for retaining a plurality of semiconductor wafers upright at regular intervals so that surfaces to be plated of the plurality of semiconductor wafers are not contacted, a supply path for supplying the plating liquid of the reserve tank to the plating bath, a circulation pump for supplying the plating liquid of the reserve tank to the plating bath through the supply path, a flowmeter for measuring velocity of the plating liquid in the supply path and a supply pipe of the plating liquid in which a plurality of spouts to erupt the plating liquid from the reserve tank to the plating bath are formed at regular intervals in an upper part, wherein a constant interval with which the plurality of semiconductor wafers are retained in the retaining means upright and a constant interval with which the plurality of spouts are formed in the upper part of the supply pipe of the plating liquid is made equal each other and the plurality of spouts formed on the upper part of the supply pipe of the plating liquid are arranged so that the plurality of the spouts are positioned between the constant interval of the plurality of semiconductor wafers retained in the retaining means when the retaining means is set up at the upper part of the supply pipe of the plating liquid which is set up at a bottom of the plating bath.

Hereinafter, the embodiment of the electroless plating apparatus according to the present invention will be described with reference to FIGS. 1 to 10. FIG. 1 is a front view to explain a composition of the electroless plating apparatus according to the present embodiment. FIG. 2 is a plan view to explain the supply pipe of the plating liquid of the electroless plating apparatus according to the present embodiment. FIG. 3 is a schematic view to explain flow of the plating liquid in a conventional electroless plating apparatus. FIG. 4 is a schematic view to explain flow of the plating liquid in the electroless plating apparatus according to the present embodiment. FIG. 5 is a perspective view to explain s composition of the plating bath of the electroless plating apparatus according to the present embodiment. FIG. 6 is a perspective view to explain a mounting plate of the retaining means arranged on the upper part of the supply pipe of the plating liquid in the electroless plating apparatus according to the present embodiment. FIG. 7 is a perspective view to explain a composition of the wafer career which is the retainer of the semiconductor wafer in the electroless plating apparatus according to the present embodiment. FIG. 8 is a perspective view to explain a composition of modification of the retaining means of the semiconductor wafer in the electroless plating apparatus according to the present embodiment. FIG. 9 is a sectional view to explain an angle adjuster of the spouts of the supply pipe of the semiconductor wafer in the electroless plating apparatus according to the present embodiment. FIG. 10 is a sectional view to explain a shape of the spout of the supply pipe of the plating liquid in the electroless plating apparatus according to the present embodiment.

Here, in the semiconductor wafer utilized in the present embodiment, as pre-process, aluminum alloy is formed on the surface to be plated with a thickness, for example, degree of 5 μm thickness by vacuum deposition method or sputtering method and the like. Further, zinc (Zn) film is formed by zincate treatment on the surface of aluminum (Al) alloy while removing oxide film of Al. Thereafter, after the zinc film is removed by immersing in nitric acid zincate treatment is conducted again. Thereby, zinc film is formed on the surface of Al (aluminum) alloy. As mentioned in the above, by conducting twice zincate treatment (double zincate treatments), elaborate zinc film is formed on the Al (aluminum) alloy surface.

The electroless plating process is conducted through Nickel (Ni) on the surface to be plated of the semiconductor wafer. That is, when the surface to be plated of the semiconductor wafer, the surface being formed of Al alloy film coated by Zinc, is immersed in the plating liquid including Nickel (Nickel Sulfate), at first Nickel is precipitated on the Al alloy surface since standard redox potential of zinc is base than nickel. Continuously, after the surface is coated by nickel, nickel film with a predetermined thickness is formed based on nickel is reduced and deposited by action of reducing agent included in the plating liquid. In the electroless plating apparatus described hereinafter, nickel film with uniformity and high quality is formed on the surface to be plated of the semiconductor wafer by using the above characteristic.

As shown in FIG. 1, the electroless plating apparatus 10 according to the present embodiment is composed by installing various devices composing the electroless plating apparatus 10 on a housing 12 composed from metallic (for example, iron, aluminum and the like) racks (shelf). As various devices, a supply pipe 15 to supply the plating liquid in a reserve tank 11*a* to a plating bath 11 is provided in the housing 12. The supply pipe 15 is communicated and connected from a lower part of the reserve tank 11*a* to a lower part of the plating bath 11. That is, a start end of the supply pipe 15 is communicated and connected to the lower part of the reserve tank 11*a* and a terminal end of the supply pipe 15 is communicated and connected to the lower part of the plating bath 11 (correctly, a substantially central part of the lower part of the a plating liquid supply pipe 20 arranged in the lower part of the plating bath 11). To the supply pipe 15, a circulation pump 13, a flowmeter 14, a filter 16 and a heater 17 are provided.

The circulation pump 13 supplies the plating liquid accumulated in the reserve tank 11*a* within the plating bath 11 with a predetermined flow rate and a predetermined pressure through the supply pipe 15, via the plating liquid supply pipe 20 arranged in the lower part of the plating bath 11. The flowmeter 14 measures flow rate of the plating liquid communicating the supply pipe 15 and controls output of the circulation pump 13 so that the plating liquid is supplied to the plating bath 11 with a predetermined pressure and a predetermined flow rate. The filter 16 removes impurities (reaction by-product, rubbish and the like) from plating liquid supplied to the plating bath 11 through the supply pipe 15. The heater 17 heats the plating liquid supplied to the plating bath 11 through the supply pipe 15 to a predetermined temperature (for example, 60° C.). As mentioned above, the plating liquid supplied to the plating bath 11 from the reserve tank 11*a* through supply pipe 15 is stably supplied with a predetermined pressure and a predetermined flow rate, impurities are removed from the plating liquid, the plating liquid is heated to a predetermined temperature and supplied. Thereby, nickel film with uniformity and high quality can be formed on the plating surface of a semiconductor wafer 40 immersed in the plating bath 11.

The plating bath 11 is set on the housing 12. As the plating bath 11, for example, a water tank formed in a box type from glass and the like and an upper part is opened will be suitably used. In the plating bath 11, the plating liquid W is filled. Basic composition of the plating liquid W in the present embodiment is composed by adding nickel sulfate ($Ni_2SO_4$), sodium hypophosphite ($2NaH_2PO_2$) as reducing agent, complexing agent and the like.

As shown in FIG. 5, at one side in a longitudinal direction of the plating bath 11, the reserve tank 11*a* is arranged. In the plating bath 11, a gutter-shaped collection path 11*b* of the plating liquid is formed so as to surround upper ends of four sides in the upper open portion. In the collection path 11*b*, a slope is formed toward the reserve tank 11*a* so as to collect the plating liquid W overflowed from the upper ends of four sides of the plating bath 11 and to accumulate in the reserve tank 11*a*.

At the upper ends of four sides of the plating bath 11, a plurality of V-shaped notches 11*c* with regular intervals. The V-shaped notches forms paths of the plating liquid W overflowing to the collection path 11*b* from the upper ends of four sides of the plating bath 11. At a center lower portion between the notches 11*c* formed at the upper ends of four sides of the plating bath 11 with regular intervals, a plurality of discharge holes 11*d* are formed with equal intervals. These discharge holes 11*d* are to form discharge path discharging impurities (rubbish and the like) included in the plating liquid W existing in the upper part of the plating bath 11 to the collection path 11*b* of the plating liquid W. Further, as shown in FIG. 5 by arrows, the plating liquid W overflowed from the plating bath 11 flows out to the collection path 11*b* from the notches 11*c* and the discharge holes 11*d* and flows down through the collection path 11*b*, thereafter the plating liquid W is accumulated in the reserve tank 11*a*.

As shown in FIG. 1, in the plating bath 11, two wafer careers 30 corresponding to the retaining means of the plurality of semiconductor wafers 40 of the present embodiment are immersed in the plating liquid W under a state that the surfaces to be plated (front and back surfaces of disc-like thin plates) of the plurality of the semiconductor wafers (in FIG. 1, 13 plates) formed in disc-like thin plate are mutually faced and the semiconductor wafers 40 are substantially vertically retained at regular intervals (for example, 4.75 mm). The wafer careers 30 are tools for it so that the plurality of disc-like semiconductor wafers can be conveyed under a state that the semiconductor wafers 40 are substantially vertically retained.

As shown in FIG. 7(*a*), in the wafer career 30, a front plate 31*a* and a rear plate 31*b* are composed from plate bodies formed in a substantially H-shape in front view. Left and right sides of the wafer career 30 are formed from left and right grasping portions 32, 32 connecting left and right upper end sides of the front plate 31*a* and the rear plate 31*b*, side grasping portions 33, 33 connecting substantial center portions of left and right sides within the same horizontal plane of the front plate 31*a* and the rear plate 31*b* and lower grasping portions 34, 34 connecting left and right lower end sides of the front plate 31*a* and the rear plate 31*b*. Thereby, a space in which the plurality of semiconductor wafers 40 can be stored is formed in the wafer career 30.

The left and right grasping portion 32, 32 are flat plates protruded toward left and right outer sides from left and right upper end sides of the front plate 31*a* and the rear plate 31*b* and functions as handles to convey the wafer career 30. In the side grasping portions 33, 33, a plurality of retaining grooves 33*a* to retain left and right side portions of the plurality of semiconductor wafers 40 are formed so as to horizontally protrude toward inner side of the wafer career 30 at regular intervals (for example, equal pitch of 4.75 mm interval). In the upper portion of the lower grasping portions 34, 34, a plurality of retaining grooves 34*a* to retain lower portions of the plurality of semiconductor wafers substantially vertically under a state that the surfaces to be plated are mutually faced, are formed at regular intervals (for example, equal pitch of 4.75 mm interval) so as to vertically protrude. Further, the plurality of retaining grooves 33*a*, 33*a* formed in the let and right side grasping portions 33 and the plurality of retaining grooves 34*a*, 34*a* formed in the left and right lower grasping portions 34, 34 are formed so as to respectively superimpose on the same horizontal line along the transverse direction of the wafer career 30 in plan view.

In the wafer career 30 composed according to the above, as shown in FIG. 7(*b*), both sides of a plurality of disc-like semiconductor wafers 40 are retained by the side grasping portions 33, 33 and the lower portion of the semiconductor wafer 40 are retained by the lower grasping portions 34, 34. The plurality of semiconductor wafers 40 can be vertically retained at substantial regular intervals under a state that the surfaces to be plated of the plurality of semiconductor wafers 40 are faced. As mentioned above, the wafer career 30 according to the present embodiment certainly retains the plurality of semiconductor wafers 40 and the wafer career 30 is composed so that flow of the plating liquid W from downward to upward on the plating surface of the semiconductor wafer 40 is not interfered. Thus, the contact area between the wafer career 30 and semiconductor wafer 40 can be reduced as much as possible.

As shown in FIG. 1, under the wafer career 30 immersed in the plating bath 11, it is arranged the plating liquid supply pipe 20 in which the plurality of spouts 21 to supply the plating liquid W from the reserve tank 11*a* to the plating bath 11 are formed at regular intervals on the upper portion of the plating liquid supply pipe 20. At substantial center lower portion of the plating liquid supply pipe 20, a terminal end of the supply pipe 15 is communicated and connected. According to this composition, the plating liquid W accumulated in the reserve tank 11*a* is supplied by the circulation pump 13 to the plating liquid supply pipe 20 from the start end of the supply pipe 15 communicated and connected to the lower portion of the reserve tank 11*a* through the terminal end of the supply pipe 15 communicated and connected to the substantial center of the lower portion of the plating liquid supply pipe 20, further the plating liquid W is supplied within the plating bath 11 from the plurality of spouts 21 formed on the upper portion of the plating liquid supply pipe 20 at regular intervals. Further, as mentioned in the above, the plating liquid W overflowed from the upper portion of the plating bath 11 is recovered through the collection path 11*b* and accumulated in the reserve tank 11*a*. That is, in the electroless plating apparatus 10, it is composed that the plating liquid W is circulated between the plating bath 11 and the reserve tank 11*a*.

As shown in FIG. 2, the plating liquid supply pipe 20 to supply the plating liquid within the plating bath 11 is composed from four supply nozzles 22 provided parallel against the longitudinal direction of the box-like plating bath 11 and three short pipes 23 communicated and connected to the center portion and both ends of the supply nozzles 22 in the vertical direction of the plating bath 11. As the supply nozzle 22 and short pipe 23, it is suitably used pipes composed of material (such as stainless steel or poly vinyl chloride and the like) not react with the plating liquid. Here, as four supply nozzles 22 of the plating liquid supply pipe 20, it is sufficient if provided least two supply nozzles as a pair at regular intervals against the longitudinal direction of the plating liquid supply pipe 20. Hereinafter, the number of the supply nozzles 22 can be appropriately changed as four or six corresponding to the size of the plating bath 11 or the semiconductor wafers 40.

On the upper portion of each of four supply nozzles 22, a plurality of spouts 21 (in FIG. 2, 28 spouts in one of supply nozzles 22) are formed at regular intervals. Further, at substantial center of the lower end of the center short pipe 23 in the plating liquid supply pipe 20, the terminal end 15*c* of the supply pipe 15 is communicated and connected. The plating liquid W supplied to the plating liquid supply pipe 20 from the terminal end 15*c* of the supply pipe 15 is erupted upward toward the plurality of wafer careers 30 therebetween arranged upward from the plurality of spouts 21. Distance between the plurality of spouts 21 is provided with a predetermined distance (in FIG., PT1 is set to the predetermined distance between the semiconductor wafers 40, which is as same as the predetermined distance that is, 4.75 mm). At that time, although details will be described hereinafter, the plating liquid W erupted upward toward the wafer career 30 from the spouts 21 is erupted upward between the predetermined distances of the plating surfaces, the predetermined distance opposing to the vertical direction of the semiconductor wafers 40 retained by the wafer careers 30.

As shown in FIG. 6, at an upper portion of the plating liquid supply pipe 20, a plurality of mounting plates 24 to mount the wafer careers 30 corresponding to the retaining means are provided. Total three mounting plates 24 are arranged upward to the short pipes 23 of both sides communicated and connected in the vertical direction of the plating bath 11 perpendicular with the supply nozzle 22 and to the central short pipe 23. The mounting plate 24 is formed in a rectangular shape, the mounting plate 24 being made of material such as fluororesin which has excellent heat resistance and chemical resistance. On the mounting plates 24 arranged at upper positions of short pipes 23 of both sides, two positioning portions 24*a* are formed at two positions, the positioning portions 24*a* positioning and mounting both lower ends 34*b*, 34*b* in the longitudinal direction of lower grasping portion 34 (see FIG. 7) in the wafer career 30. On the mounting plate 24 arranged at an upper position of the central short pipe 23, four positioning portions 24*a* are formed, the positioning portions 24*a* positioning and mounting both lower ends 34*b*, 34*b* in the longitudinal direction of lower grasping portion 34 (see FIG. 7) in the wafer career 30.

Further, as shown in FIG. 7(*b*), just by fitting and placing both lower ends 34*b*, 34*b* of the lower grasping portion 34 of the wafer career 30 to the positioning portions 24*a* formed on the mounting plate 24, the plurality of spouts 21 formed at regular intervals are positioned toward predetermined regular intervals of the surfaces to be plated of the semiconductor wafer 40 retained by the wafer career 30 arranged at the upper portion of the plating liquid supply pipe 20, That is, just by fitting and placing both lower ends 34*b*, 34*b* of the lower grasping portion 34 of the wafer career 30 to the positioning portions 24*a* formed on the mounting plate 24, while grasping the left and right grasping portions 32 of two wafer careers 30 and immersing in the plating liquid W of the plating bath 11, the plating liquid W can be easily erupted upward from the plurality of spouts 21 toward the predetermined spaces between plating surfaces of the semiconductor wafer 40 retained by the wafer careers 30.

Hereinafter, with reference to FIGS. 3 and 4, it will be described flow of the plating liquid in the semiconductor wafer 40 substantially vertically retained in the wafer careers 30 immersed in the plating bath 11 so that the plating surfaces mutually face.

As shown in FIG. 3, in the conventional apparatus, the spouts 21 formed at the upper position of the plating liquid supply pipe 20 do not necessarily communicate upward between two semiconductor wafer 40 retained in the wafer career 30 so that the plating surfaces mutually face. That is, the predetermined distance PT1 between the two semiconductor wafers 40 is different from the predetermined distance PT2 between the spouts 21 formed at the upper position of the plating liquid supply pipe 20.

Due to this, in a case that the plating liquid communicates upward between two semiconductor wafer 40, the plating liquid smoothly communicates (up arrow in FIG.). Otherwise, it will occur a case that the plating liquid communicates downward (down arrow in FIG.) between adjacent two semiconductor wafers due to that the plating liquid is sucked out by rapid flow of the plating liquid flowing upward between two semiconductor wafers 40.

Further, in a case that flow between two semiconductor wafers 40 is mutually different, vortex occurs under the semiconductor wafers 40 retained in the wafer career 30 immersed in the plating bath 11. Further, in the upper portion laminar flow having different flow in up and down is formed. Furthermore, turbulence or stagnant flow occurs in the upper portion of the semiconductor wafer 40.

As mentioned in the above, bubbles of hydrogen occur by chemical reaction in the plating liquid during the electroless plating process. The bubbles of hydrogen continue to adhere to and stay on the plating surface of the semiconductor wafer 40 due to stagnant flow occurring in the upper portion of the semiconductor wafer 40. Thereby, it does not occur chemical reaction that nickel is reduced and deposited through function of reducing agent included in the plating liquid on the plating surface where bubbles of hydrogen are adhered. As a result, unevenness occurs in nickel film, thus uniformity in membranous and high quality cannot be realized.

On the contrary, as shown in FIG. 4, in the electroless plating apparatus according to the present embodiment, the predetermined interval PT1 of the plurality of semiconductor wafers 40 is made quietly as same as the predetermined interval PT1 of the plurality of spouts 21 formed on the plating liquid supply pipe 20. Thereby, just by shifting the semiconductor career 30 retaining the plurality of semiconductor wafers 40 a certain distance along the longitudinal direction of the plating liquid supply pipe 20 and mounting on the plating liquid supply pipe 20, the plating liquid W is communicated from the lower portion to the upper portion between the semiconductor wafers 40 retained in the wafer career 30 so as to mutually oppose. Here, each of the plurality of spouts formed on the upper part of the supply pipe of the plating liquid is arranged so as to be positioned corresponding to the regular interval between two semiconductor wafers when the retaining means is set up at the upper part of the supply pipe of the plating liquid which is set up at a bottom of the plating bath.

That is, as shown in FIG. 7(*b*), in the preset embodiment, just by fitting the both lower ends 34*b*, 34*b* of the lower grasping portion 34 of the wafer career 30 in the positioning portion 24*a* formed on the mounting plate 24 and mounting, the predetermined interval PT1 between the semiconductor wafers 40 provided at regular intervals is installed by shifting a certain distance from the position of the predetermined interval PT1 between the spouts 21 formed on the plating liquid supply pipe 20. Thereby, the plating liquid W can be communicated from the lower portion to the upper portion between the predetermined intervals PT1 of the plating surfaces of the semiconductor wafers 40 retained in the wafer career 30 arranged over the plating liquid supply pipe 20.

As mentioned in the above, since the plating liquid W can be uniformly communicated from the lower portion to the upper portion on the plating surfaces of the plurality of semiconductor wafers 40 retained in the wafer career 30 immersed in the plating liquid W of the plating bath 11, it can be kept low as much as possible that vortex, laminar flow, turbulence or stagnant flow occurs.

Thereby, in a case that bubbles of hydrogen occur due to chemical reaction in the plating liquid, bubbles of hydrogen can be flown upward, therefore it can be prevented that bubbles of hydrogen adhere to the plating surface of the semiconductor wafer 40 and stay there. Thereby, it can be prevented that unevenness occurs in nickel film formed on the plating surface, thus the plating film with uniform film quality and high quality can be formed.

It will be described with reference to FIG. 8 a modification of the retaining means of the semiconductor wafer 40 in the present embodiment. Although in the embodiment described above it is described the composition in which the semiconductor wafers 4 are substantially vertically retained in the wafer career 30 so that the plating surfaces mutually oppose, it is not necessary to use the wafer career 30 as the retaining means.

That is, as shown in FIG. 8(*a*), at the upper portion of the plating liquid supply pipe 20, two mounting plates 24 are arranged at two positions over the short pipes of both ends communicated and connected in the vertical direction of the plating bath 11 perpendicular to the supply nozzle 22. Further, two wafer mounting portions 50, 50 as the retaining means of the modification are suspended parallel with the longitudinal direction of the plating liquid supply pipe 20 between the mounting plates 24 at both ends. These mounting portions 50, 50 are composed so that lower both sides portions of the semiconductor wafer 40 are retained so as to be kept even.

On the upper portion of the two wafer mounding portions 50, 50, a plurality of retaining grooves 50*a* to substantially vertically retain the plurality of semiconductor wafers 40 while mutually facing the plating surfaces are formed at regular intervals (for example, equal pitch of 4.75 mm). The plurality of retaining grooves 50*a*, 50*a* are formed so as to respectively superimpose on the same horizontal line in the vertical direction of the plating liquid supply pipe 20 in plan view. The predetermined distance of the retaining grooves 50*a* is as same as the predetermined distance of PT1 (see FIG. 2) of the plurality of spouts 21 formed on the supply nozzle 22. Further, the wafer mounting portions 50, 50 are arranged under a state that the wafer mounting portions 50, 50 are shifted the position thereof in the longitudinal direction of the supply nozzle 22, so that the predetermined distance of the plurality of retaining grooves 50*a* and the predetermined distance PT1 of the plurality of spouts 21 on the supply nozzle 22 are not superimposed.

Further. as shown in FIG. 8(*b*), the semiconductor wafers 40 are substantially vertically retained under a state that plating surfaces of the semiconductor wafers 40 are mutually opposed by the retaining grooves 50*a* formed on the two wafer mounting portions 50, 50. As mentioned, without using the wafer career 30, the plurality of semiconductor wafers 40 are substantially vertically retained at regular intervals by the wafer mounting portions 50, 50 at two points of the lower both sides of the plurality of semiconductor wafers. Thereby, it can be reduced as much as possible a fear that communication of the plating liquid communicating from downward to upward through the plating surfaces of the semiconductor wafers 40 in the plating bath 11 is hindered. Thereby, it can be formed the metallic plating film having predetermined thickness with uniformity and high quality on the plating surfaces of the semiconductor wafers 40.

Here, in the modification of the retaining means shown in FIG. 8, the positioning portions 24*a* to position and mount the both lower ends 34*b*, 34*b* of the lower retaining portion 34 of the wafer career 30 described above are not formed on the mounting plate 24, instead the mounting plate 24 having flat surface and rectangular shape is used.

Here, in four supply nozzles 22 of the plating liquid supply pipe 20, angles of the spouts 21 to erupt the plating liquid W upward to the plating surfaces of the plurality of semiconductor wafers 40 positioned in the upper position are made adjustable within a range by making a central axis of the supply nozzle 22 as a rotational axis. That is, as shown in FIG. 9(*a*), angles of the spouts 21 is made freely rotatable within a predetermined angle θ (for example, 2~4 degrees in left and right) by making the central axis 22*a* of the supply nozzle 22 as the rotational axis. Thereby, as shown in FIG. 9(*b*), angles of spouts 21 of the four supply nozzles 22 of the plating liquid supply pipe 20 arranged at the lower position of the semiconductor wafer 40 can be displaced toward the substantially central portion of the plating surface 40*a* of the semiconductor wafer 40.

That is, the plating surface 40*a* of the semiconductor wafer 40 formed in disc-like shape is round shape. Thus, area necessary to be plated near the center of the plating surface 40*a* becomes wider. In a case that the plating liquid W is merely erupted vertically upward from the spouts 21, the plating liquid W of the same quantity as used for the center of the plating surface 40*a* from downward to upward comes to flow to the plating surface 40*a* with narrow area necessary to be plated outer side from the center of the circle plating surface 40*a*. Therefore, as shown in FIG. 9(*b*), angle of the spouts 21 distant from the center of the plating surface 40*a* is changed toward the center of the circle plating surface 40*a*. Thereby, the plating liquid W from the spouts 21 of the supply nozzle 22 can be concentrated and efficiently communicated from the lower portion to the upper portion (in FIG., dotted arrow) toward the substantially central portion of the plating surface 40*a* of the semiconductor wafer 40, as a result, the plating film with uniformity and high quality can be formed on the plating surface 40*a*.

Further, the plurality of spouts 21 formed in the supply nozzle 22 to erupt the plating liquid W upward can also be formed in a conical shape expanded downward. That is, as shown in FIG. 10(*a*), the spout 21 is formed in a conical shape expanded downward in side view. As shown in FIG. 10(*b*), in the conventional spout 21 formed in a cylindrical shape, although the plating liquid W is ejected upward in a substantially central portion, there will be a case that ejection pressure goes down (in FIG., dotted arrow) due to friction with the side walls 21*a* near side walls 21*a* of spout 21 formed parallel. Thus, based on that each of the plurality of spouts 21 is formed in a conical shape expanded downward, as shown in FIG. 10(*a*), the plating liquid W can be substantially uniformly ejected from the lower portion to the upper portion other than the substantially central portion, without decreasing ejection pressure (in FIG., dotted arrow). Thereby, ejection pressure of the plating liquid W ejected upward from the spouts 21 can be made substantially uniform, as a result, the above composition will become help to form plating film with uniformity and high quality.

As mentioned in the above, according to the electroless plating apparatus 10 of the present embodiment, flow of the plating liquid passing from the lower portion to the upper portion between the semiconductor wafers 40 can be made uniform and it can be kept low as much as possible that bubbles of hydrogen occurring in the plating liquid W during the electroless plating process adheres to and stays on the plating surface of the semiconductor wafer 40. Thereby, it can be prevented that unevenness of film thickness of the plating surface of the semiconductor wafer 40 occurs, thus the plating film with uniform thickness and high quality can be formed. That is, nickel plating film having a predetermined film thickness with uniformity and high quality can be formed on the plating surface of the semiconductor wafer 40, while considering cost reduction and environment load by using the plating bath 11 with a bare minimum size in which the plating liquid W is filled.

Although the present invention is explained according to the present embodiment in the above, the present invention is not limited to the present embodiment. Further, the above mentioned each effect merely enumerates the most suitable effects occurring from the present invention, thus effects by the present invention are not limited to effects described in the present embodiment.

REFERENCE SIGNS

10 electroless plating apparatus
11 plating bath
11*a* reserve tank
12 housing
13 circulation pump
14 flowmeter
15 supply path
16 filter
17 heater
20 plating liquid supply pipe
21 spout
22 supply nozzle
23 short pipe
30 wafer career
40 semiconductor wafer

The invention claimed is:

1. An electroless plating apparatus comprising:

a plating bath in which plating liquid is filled;

a reserve tank for accumulating the plating liquid overflowed from the plating bath;

a retaining means for retaining a plurality of semiconductor wafers upright at regular intervals so that surfaces to be plated of the plurality of semiconductor wafers are not contacted;

a supply path for supplying the plating liquid of the reserve tank to the plating bath;

a circulation pump for supplying the plating liquid of the reserve tank to the plating bath through the supply path;

a flowmeter for measuring velocity of the plating liquid in the supply path; and a supply pipe of the plating liquid in which a plurality of spouts to erupt the plating liquid from the reserve tank to the plating bath is formed at regular intervals in an upper part;

wherein the regular interval with which the plurality of semiconductor wafers is retained in the retaining means upright and the regular interval with which the plurality of spouts is formed on the upper part of the supply pipe of the plating liquid are mutually made equal, wherein the plurality of spouts formed on the upper part of the supply pipe of the plating liquid is arranged so that the plurality of spouts is positioned between the regular intervals of the plurality of semiconductor wafers retained in the retaining means when the retaining means is set up at the upper part of the supply pipe of the plating liquid which is set up at a bottom of the plating bath, and wherein in the supply pipe of the plating liquid, an angle of the plurality of spouts to erupt the plating liquid upward is made adjustable within a predetermined range by making a center axis of the supply pipe of the plating liquid as a pivot shaft.

2. The electroless plating apparatus according to claim 1, wherein the retaining means is a wafer carrier in which strength to retain the plurality of semiconductor wafers is secured and an area contacting with the plurality of semiconductor wafers is formed minimum.

3. The electroless plating apparatus according to claim 1, wherein the plurality of spouts is formed in conical shape expanded downward.

* * * * *